US005421044A

United States Patent [19]

Steensen

[11] Patent Number: 5,421,044

[45] Date of Patent: Jun. 6, 1995

[54] AIR BED

[76] Inventor: Steen W. Steensen, 509 N. "T" St., Lompoc, Calif. 93436

[21] Appl. No.: 113,712

[22] Filed: Aug. 27, 1993

[51] Int. Cl.[6] ..... A47C 27/08

[52] U.S. Cl. ..... 5/453; 5/455; 5/456; 5/470

[58] Field of Search ..... 5/453, 455, 456, 449, 5/470

[56] References Cited

U.S. PATENT DOCUMENTS

| | | | |
|---|---|---|---|
| 779,576 | 1/1905 | Berryman | 5/455 |
| 4,190,286 | 2/1980 | Bentley | 297/284 |
| 4,193,149 | 3/1980 | Welch | 5/455 |
| 4,221,013 | 9/1980 | Echevarria | 5/455 |
| 4,224,706 | 9/1980 | Young et al. | 5/499 |
| 4,306,322 | 12/1981 | Young et al. | 5/455 |
| 4,622,706 | 11/1986 | Takeuchi | 5/455 |
| 4,757,564 | 7/1988 | Goodale | 5/470 |
| 4,890,344 | 1/1990 | Walker | 5/449 |
| 4,947,500 | 8/1990 | Seiler | 5/455 |
| 5,070,560 | 12/1991 | Wilkinson | 5/455 |

FOREIGN PATENT DOCUMENTS

| | | | |
|---|---|---|---|
| 1113473 | 3/1956 | France | 5/456 |

*Primary Examiner*—Michael J. Milano
*Attorney, Agent, or Firm*—Ladas & Parry

[57] ABSTRACT

An air bed is disclosed comprising an enclosure formed from a flat rectangular bottom panel, a lower vertical panel standing perpendicularly up from the periphery of the bottom panel, an upper vertical panel disposed above the lower vertical panel, a gusset connecting the lower and upper vertical panels, a rectangular top panel removably connected to the upper vertical panel, and a plurality of restraining straps, with one end of each restraining strap connected to the gusset along the left side of the enclosure and the other end of each restraining strap attached to the gusset along the right side of the enclosure. The enclosure has upper level and lower levels separated by the restraining straps. In each level inflatable air tubes are inserted. Each level of tubes includes bolster tubes inserted parallel and adjacent to the sides and ends of the enclosure, and cushion tubes which are disposed laterally across the enclosure in the rectangular space surrounded by the bolster tubes. Each tube has sheathing surrounding it to reduce noise when adjacent tubes rub against each other, and attachment means are used to prevent rotation of the tubes. An air pump provides air pressure to the inflatable tubes through a manifold block having several separate, variably controlled output ports. An air hose assembly connects the manifold's output ports to the various tubes so that certain combinations of tubes receive various air pressures. In addition, the invention includes a single level embodiment.

24 Claims, 8 Drawing Sheets

AIR BED

BACKGROUND OF THE INVENTION

1. Field of the Invention

This invention relates to an improved air bed which may be used in vehicles, in the home, or in other locations.

2. Prior Art

Air beds have been in common usage for many decades. Such beds typically comprise (i) a single, large, air-tight bladder-shaped in the form of a mattress, or (ii) a plurality of air-tight bladders arranged together to form a mattress. One of the common forms of bladders used for air beds is a cylindrical tube formed of vinyl. Using a plurality of cylindrical tube bladders provides several advantages. Among them is the ability to make continued use of the air bed if only one or two of the tubes is damaged and forms a leak. Only the effected tube needs to be replaced (instead of the entire mattress in the event a leak occurs), and the tubes may be disposed relative to each other in a variety of ways, so that chairs and sofas comprised of air-filled compartments, as well as mattresses, could be formed.

It has also been known to have the tubes of an air bed connected to a pump assembly to vary the air pressure within each tube. U.S. Pat. No. 4,193,149, issued to Welch, discloses a mattress having two or three layers of inflatable tubes, each tube disposed laterally across the bed. The tubes are connected to an air pump in a manner such that the tubes are inflated and deflated in a sequential order so that a person lying on it has his weight supporting areas continually changed.

U.S. Pat. No. 3,363,941, issued to Wierwille, discloses an automobile seat having an air flotation assembly comprised of a plurality of rubber air tubes connected to a control panel of an air pump assembly so that the pressures in the air tubes may be manually adjusted relative to each other.

U.S. Pat. No. 3,303,518, issued to Ingram, U.S. Pat. No. 4,452,547, issued to Sato, and U.S. Pat. No. 4,190,286, issued to Bentley, disclose mattresses and cushions having compartments connected to air pump assemblies in which the air pressures may be individually controlled.

However, none of the prior art air beds or cushions comprise such structure so as to provide the comfort and versatility of the air bed of the present invention.

BRIEF SUMMARY OF THE INVENTION

The present invention is an air bed which in its preferred embodiment comprises an enclosure formed from a substantially flat rectangular bottom panel, a lower vertical panel standing perpendicularly up from, surrounding and connected to the periphery of the bottom panel, an upper vertical panel disposed vertically above the lower vertical panel, a gusset disposed between and connecting the lower and upper vertical panels, a substantially flat, rectangular top panel removably connected to the top edge of the upper vertical panel, and a plurality of restraining straps disposed across the width of the enclosure, with one end of each restraining strap connected to the gusset along the left side of the enclosure and the other end of each restraining strap attached to the gusset along the right side of the enclosure.

The enclosure so formed has an upper level and a lower level separated by the restraining straps. In each level inflatable air tubes are inserted. Each of the upper and lower sets of air tubes includes bolster tubes which are inserted parallel and adjacent to the sides and ends of the enclosure, and cushion tubes which are disposed laterally across the enclosure in the rectangular space surrounded by the bolster tubes.

Each tube has sheathing means surrounding it to reduce the creation of noise when adjacent tubes rub against each other, and attachment means are used to prevent the tubes from rotating relative to the enclosure.

An air pump provides air pressure to the inflatable tubes through a manifold block having several separate, variably controlled output ports.

An air hose assembly connects the manifold's output ports to the various tubes so that certain combinations of tubes receive various air pressures.

In addition, the invention includes a single level embodiment.

DETAILED DESCRIPTION OF THE INVENTION

Figure 1:
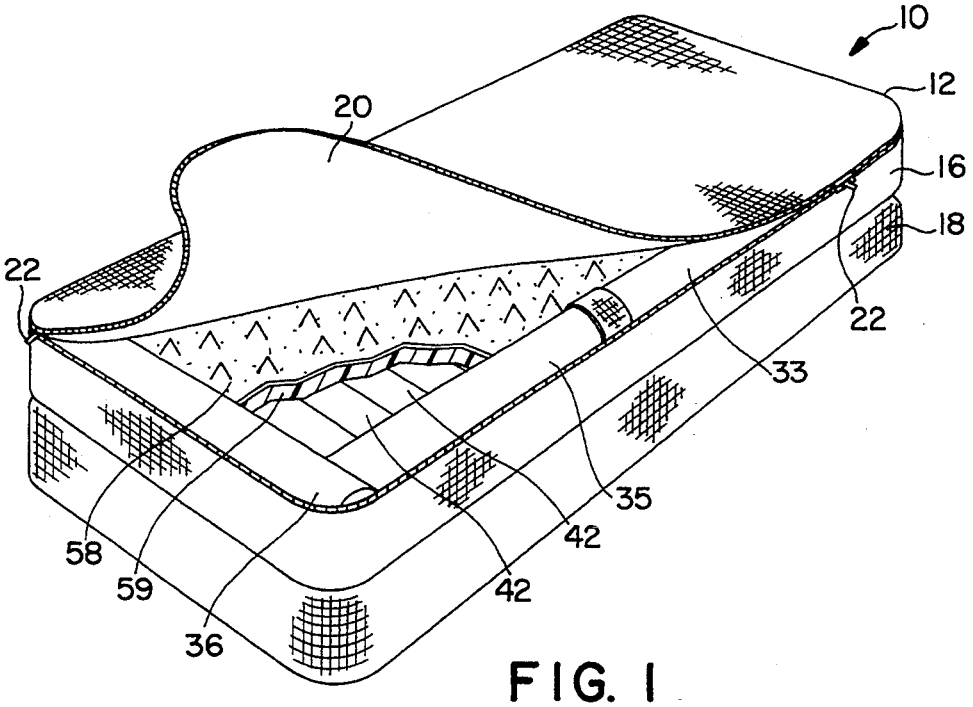
FIG. 1 is a perspective view of a preferred embodiment of the air bed of the present invention, with the right foot portion of the bed closest to the viewer and with the top partially opened and the interior partially broken to illustrate interior detail.

The preferred embodiments of the air bed of the present invention are illustrated in the attached drawings. Identical elements will be identified by the same reference numerals throughout this description.

In FIGS. 1–9 the embodiment of the present invention which is intended for use in vehicles (such as trucks, recreational vehicles, and boats) is illustrated.

Figure 2:
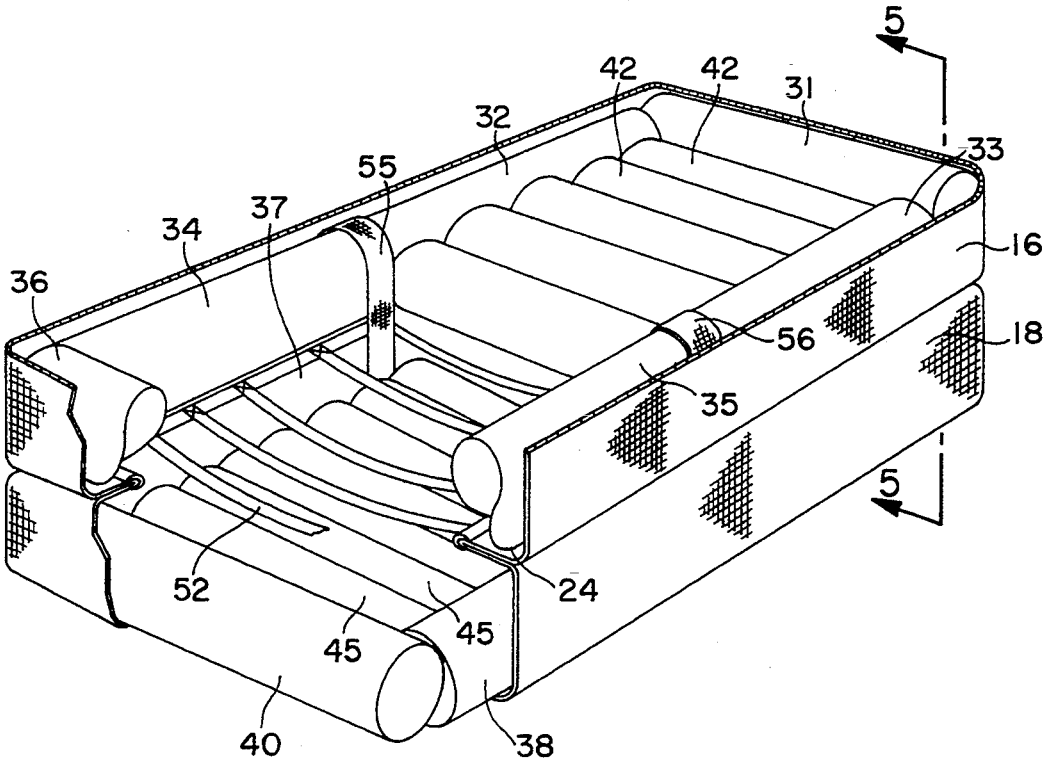
FIG. 2 is a broken perspective view of the air bed of the present invention, with the right foot portion of the bed closest to the viewer.
Figure 3:
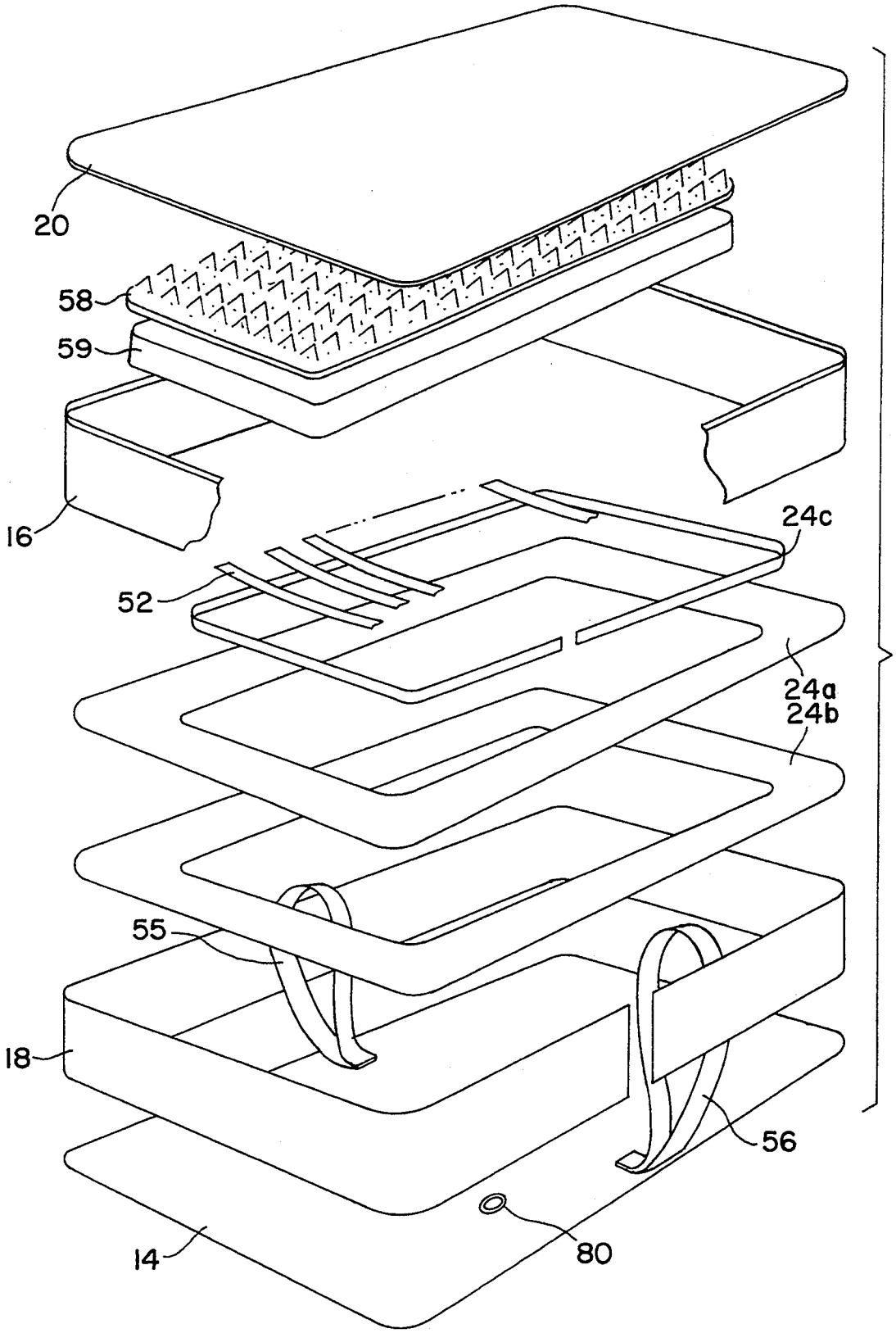
FIG. 3 is an exploded perspective view of the air bed of the present invention, with the air tubes deleted.

Referring to FIGS. 1–3, this "transport" embodiment 10 comprises an outer covering 12. The outer covering is formed of flexible material and has a bottom panel 14 formed of rip stop nylon, upper and lower vertical panels 16 and 18, respectively, and a top panel 20.

Each of the top and bottom panels are substantially flat and rectangular, and have a length and width chosen to conform to the space the air bed is to fit into when the bed is being used for its intended purpose.

Each of the lower and upper vertical panels is formed of a rectangular strip of conventional mattress covering (i.e., ticking, foam and backing), the strip having a height approximately one half the intended height of the bed and a length equal to twice the sum of the intended length and width of the bed. The ends of each vertical panel strip are sewn together so that each forms an upstanding wall. The bottom edge of the lower vertical panel is sewn to the periphery of the bottom panel with nylon thread.

The top edge of the lower vertical panel is attached to the bottom edge of the upper vertical panel by means of a gusset 24.

Figure 5:
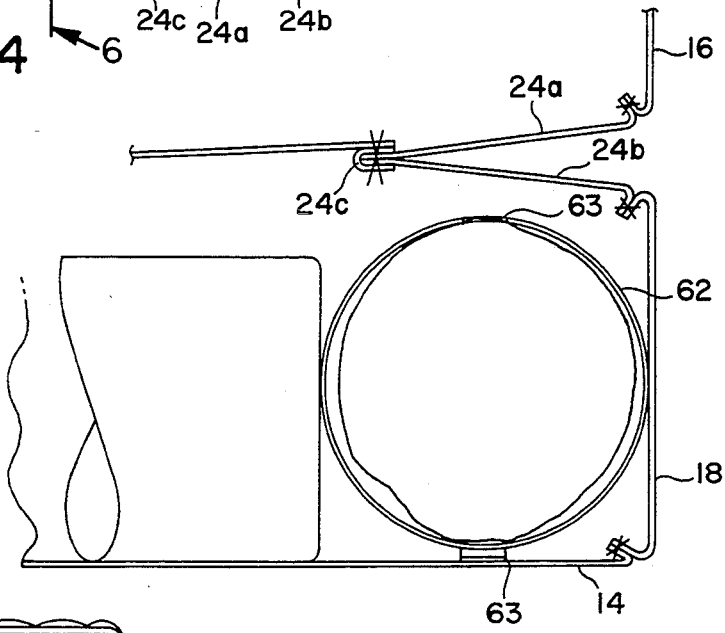
FIG. 5 is a fragmentary cross sectional view of the bottom portion of the air bed of the present invention shown in exaggerated form to illustrate detail, taken along lines 5—5 of FIG. 1.

Gusset 24 is formed of a pair of rectangular rings **24*a* and 24*b*, and reinforcing strip 24*c*, all made of rip stop nylon. As shown in FIG. 5, the outer edge of the lower rectangular ring 24*b* is sewn to the upper edge of the lower vertical panel 18, the outer edge of the upper rectangular ring 24*a* is sewn to the lower edge of upper vertical panel 16, and the inner edges of the rectangular rings are enfolded in and sewn together with reinforcing strip 24*c*** using nylon thread. In an alternative preferred embodiment, the gusset may be formed from the reinforcing strip and a single rectangular ring which is folded in half along the imaginary line parallel to and midway between its outer edges. The crease of the folded rectangular ring is then sewn onto the folded reinforcing strip. One outer edge of the single rectangular ring is sewn to the upper edge of the lower vertical panel and the other outer edge of the single rectangular ring is sewn to the lower edge of the upper vertical panel.

Top panel 20, which in the transport embodiment is formed of conventional mattress covering, is removably joined to the upper vertical panel through the use of a zipper attachment means 22 which is disposed along the periphery of the top panel and the upper edge of the upper vertical panel.

The outer covering 12, comprised of the bottom, upper side, lower side and top panels, forms an enclosure into which air tubes 31, 32, 33, 34, 35, 36, 37, 38, 39, 40, 42 and 45 are disposed. The air tubes are formed from 20 mil thick vinyl. In the preferred embodiment, the air tubes are cylindrical with circular cross-sections. Tubes having other cross-sections (e.g., elliptical or rectangular) may also be used.

To help prevent the vertical panels of the outer covering from bowing outward when weight is placed on the top surface of the air bed, a series of restraining straps 52, made from rip stop nylon, are disposed across the width of the air bed. The ends of the restraining straps are sewn with nylon thread to the reinforcing strip (and the portion of the rectangular ring enclosed within the folded strip) as shown in FIG. 5, on opposite sides of the bed. The restraining straps are spaced apart so that they substantially align with the depressions between the laterally disposed adjacent cushion tubes 45.

Figure 6:
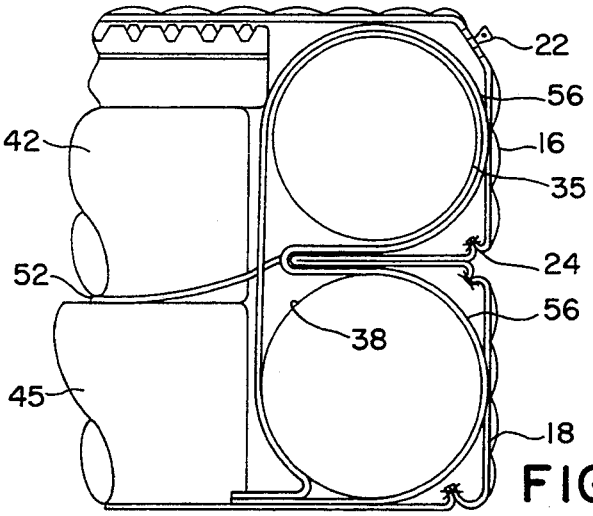
FIG. 6 is a fragmentary cross sectional view of the air bed of the present invention taken along lines 6—6 of FIG. 4.

To help prevent the inwardly disposed ends of upper side bolster air tubes 32, 33, 34 and 35 from bulging upwardly, cinch belts 55 and 56 are sewn into the bottom panel and have sufficient length to fit around the upper and lower side bolster air tubes 32, 33, 34, 35, 37 and 38 as illustrated in FIG. 6. (The inwardly disposed ends of upper side bolsters 32, 33, 34 and 35 are shown in phantom lines under belts 55 and 56 in FIG. 2.) The cinch belts are several inches wide and are made from elastic material similar to that found in waist bands.

The air tubes are fitted into the outer covering and either or both of "egg crate" polyurethane foam pad 58 and rectangular polyurethane foam pad 59 are then placed on top of the upper laterally disposed cushion air tubes 42 in the space bounded by upper side bolster air tubes 32, 33, 34 and 35 and upper end bolster air tubes 31 and 36. The foam pads are used to provide a soft cushioned feel to the user, and to provide a level top surface. The top surface would otherwise have its outside edges extending substantially above the interior portions of the top surface due to the fact that the bolster air tubes 31, 32, 33, 34, 35, 36, 37, 38, 39 and 40 will typically be 8" diameter tubes while all the interior tubes (i.e., the upper laterally disposed cushion air tubes 42 and the lower laterally disposed cushion air tubes 45) will be 7" diameter tubes, and the height of the two levels of bolster tubes will therefore be 2" greater than the height of the two levels of interior tubes.

In the transport embodiment, only one foam pad will typically be used, usually the egg crate foam pad 58.

Figure 4:
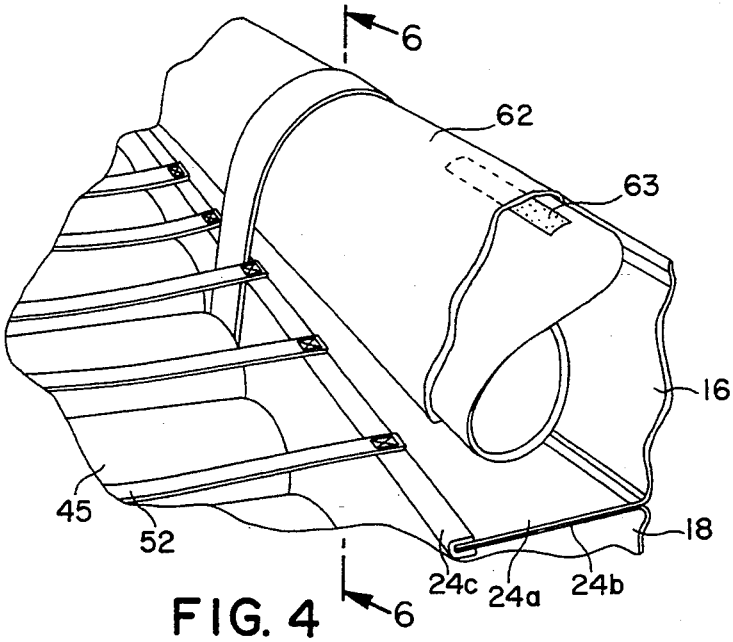
FIG. 4 is a fragmentary, broken perspective view of an upper right side bolster air tube and surrounding structure.

Referring to FIGS. 4 and 5, side and end bolster tubes are placed within a sheath 62. The purpose of the sheath is to prevent the squeaking noises typically created when vinyl air tubes rub against each other. The sheath may be made of a textile material such as a polyester cotton flannel, nylon or olefin (as for example, Polytex TM material from Culp Ticking of Commerce, Calif.).

Each bolster tube and the sheath into which it is placed have hook and pile attachment means 63, such as Velcro ®, affixed at each end of the tube so that the bolster tube will not rotate relative to the sheath. It is preferred that the pile side of the attachment means be affixed to the bolster tube so that catching of the bolster tube as it is slid into the sheath is minimized. The pile side of the attachment means is adhesively affixed to the air tube and the hook side of the attachment means may be either sewn or adhesively affixed to the sheath.

Hook and pile attachment means are also adhesively affixed or sewn to each end of the sheath and an abutting portion of the enclosure, such as bottom panel 14, as shown in FIG. 5, and such as the gusset portion **24*a***. This prevents the sheath, and concomitantly the bolster tube, from rotating relative to the enclosure. Such rotation is to be prevented in order to preclude entanglement or other damage to air hoses described below.

Figure 7:
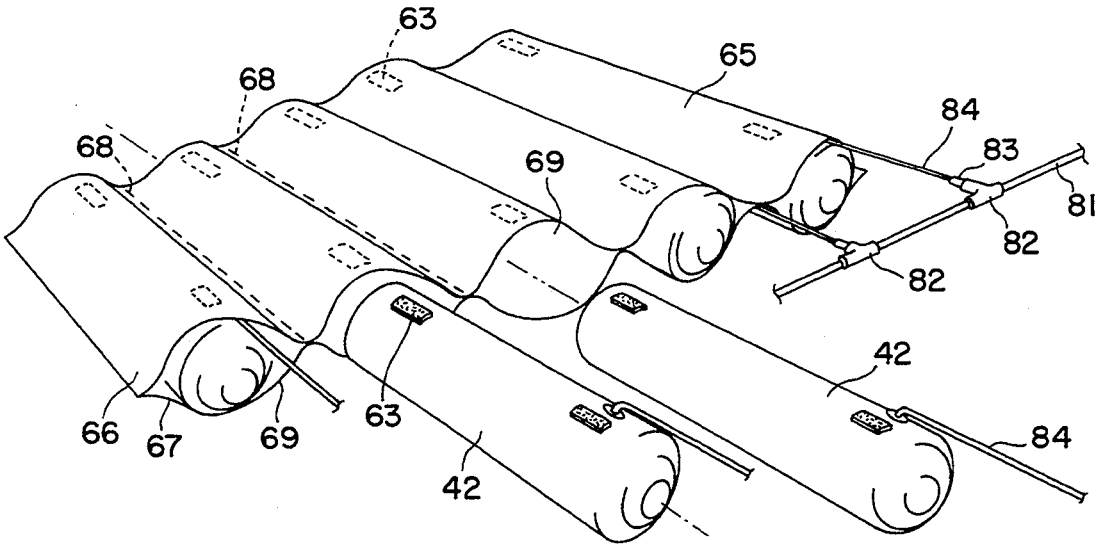
FIG. 7 is a perspective view showing the magazine into which cushion air tubes are inserted prior to their being disposed into the air bed of the present invention.

Each of the laterally disposed cushion tubes may be similarly disposed within a sheath. However, referring to FIG. 7, in the preferred embodiment each set of laterally disposed cushion tubes comprising the upper or lower level of cushion tubes is disposed in a magazine 65. (Tubes 42 of the upper level are illustrated in FIG. 7 by way of example.) Each magazine is formed of two rectangular sheets 66 and 67 made from the same material as sheath 62.

The rectangular sheets are laid one on top of the other and the laterally extending ends of sheet 66 are sewn to the corresponding ends of sheet 67. Then the sheets are sewn together along a series of imaginary laterally extending lines 68 which are spaced sufficiently apart so that a series of sleeves 69 are created, each of which can receive a fully inflated laterally disposed cushion tube. When 7" cushion tubes are used, the lines should be spaced just over 11" apart. The lines may be double-stitched for extra strength.

Hook and pile attachment means are affixed to the interior of the open sides of each sleeve and on corresponding portions of the cushion tubes to prevent the tubes from rotating relative to the magazine. Since the magazine cannot rotate relative to the enclosure (i.e., the enclosure formed by the top, bottom and vertical panels), there is no need to attach the magazine to the enclosure, although the ends of the magazine could be attached by hook and pile attachment means to the portions of the gusset at the ends of the air bed.

Figure 9:
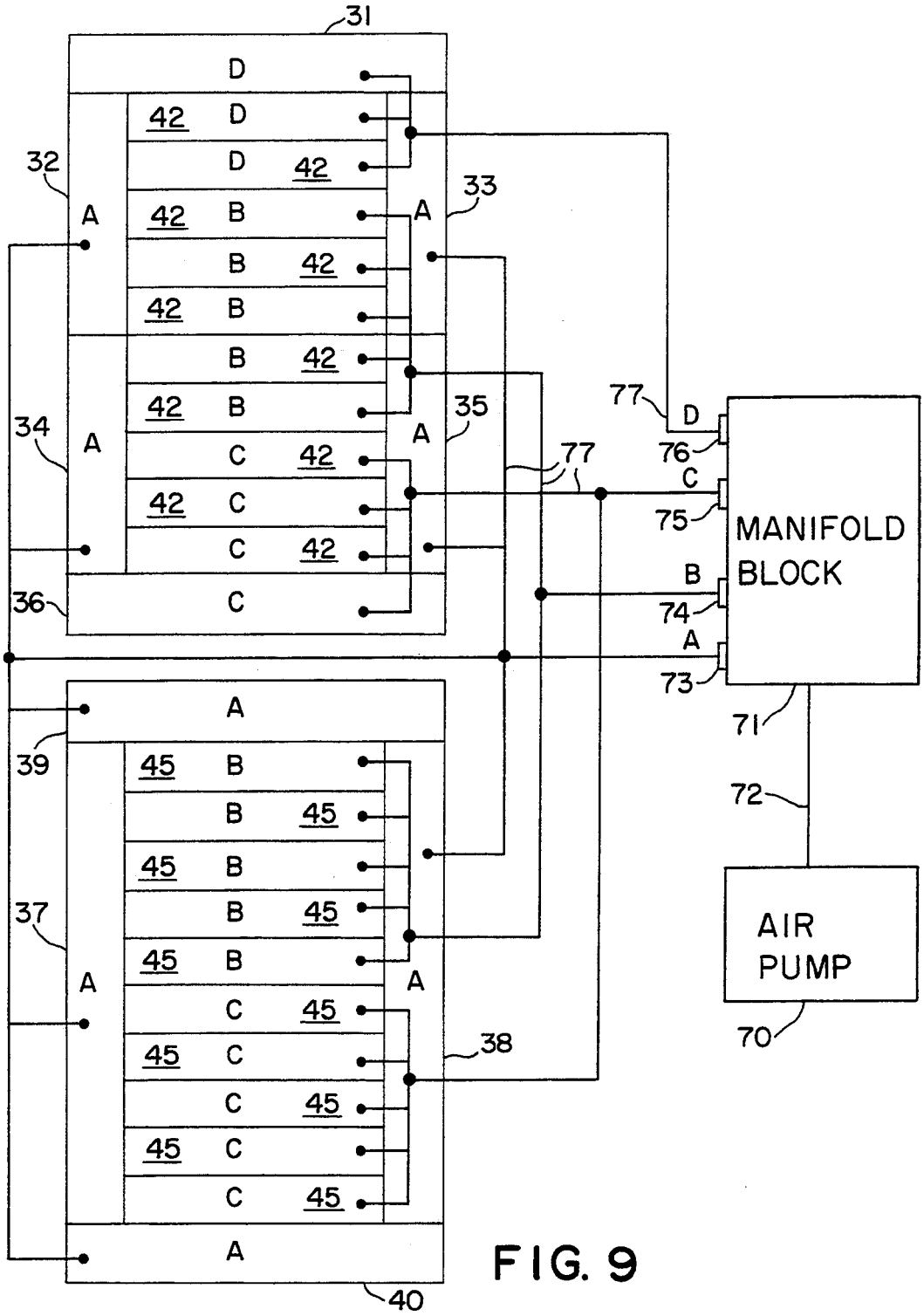
FIG. 9 is a schematic diagram illustrating the arrangement of the system for delivering air to the air tubes of the present invention.

FIG. 9 illustrates schematically how the various tubes relate to each other, and to the air pump 70 and manifold block 71 which also form parts of the preferred embodiment of the invention.

Air pump 70 provides the air pressure for filling all of the air tubes. The air pump is connected to the input of manifold block 71 through air hose 72. The manifold block has at least two output ports, and in the preferred embodiment has four output ports 73, 74, 75 and 76 which provide output air pressures A, B, C and D respectively, each of which is variable. Each of the output air pressures may be controlled a separate dial located on the manifold block or by a remotely held device, similar to remote controls used for televisions, VCRs and stereo tuners.

The output pressures of each of the output ports may be variable over the same range. The ultimate relative pressures will be determined by the particular comfort desires of the user. However, it is expected that output pressure A would usually be set higher than output pressure B, output pressure B would be set higher than output pressure C and output pressure C would be set higher than output pressure D.

The manifold block outputs are connected to the air tubes by air hose assembly 77.

The lower layer of air tubes, comprising lower left side bolster tube 37, lower right side bolster tube 38, lower head end bolster tube 39, lower foot end bolster tube 40, and lower laterally extending cushion tubes 45 is shown in the bottom half of FIG. 9. The head and foot end bolster tubes have a length approximately equal to the width of the bed. The lower side bolster tubes have a length approximately equal to the length of the bed less the diameters of the head and foot end bolster tubes. The length of the cushion tubes is approximately equal to the width of the bed less the diameters of the left and right side bolster tubes. The upper layer of air tubes, comprising upper head end bolster tube 31, upper left side torso bolster tube 32, upper right side torso bolster tube 33, upper left side leg bolster tube 34, upper right side leg bolster tube 35, upper foot end bolster tube 36, and upper laterally extending cushion tubes 42 is shown in the top half of FIG. 9.

In the preferred embodiment for every tube in the lower layer there is an identical vertically aligned tube in the upper layer, with the exception that where there is a single, long lower left side bolster tube 37 and a single, long lower right side bolster tube 38 in the lower level of tubes, there are in the upper level of tubes two left side bolster tubes 32 and 34 and two right side bolster tubes 33 and 35, each one half the length of the bolster tube underneath it. This provides for more comfortable seating when the user is seated on the edge of the bed while allowing for the bed edges to remain firm, as described below. (In a less preferred embodiment, the two upper left side bolster tubes may be replaced by a single, long left side bolster and the upper right side bolster tube may be replaced by a single long right side bolster tube.)

Each tube is marked in FIG. 9 to indicate the air pressure being delivered to it (e.g., all side bolsters are marked with the letter A, the laterally extending cushion tubes nearer to the head end of the lower level of the bed are marked with the letter B, the laterally extending cushion tubes nearest the foot end of the bed are marked with the letter C, and the laterally extending cushion tubes nearer to the head end of the upper layer of the bed are marked with the letter D).

All the side bolster tubes are connected by the air hose assembly to one of the output ports, namely output port 73. In the preferred embodiment these tubes are maintained at the highest pressure A. This keeps the edges where a user sits firm to hold up the concentrated weight of the user, and helps maintain the user away from the side edges of the bed when the user is reclining on it. This is particularly useful in the transport embodiment of the air bed which may be used in recreational vehicles or in the rear portion of the cab of a truck traveling at high rates of speed over a curry or bumpy roadway. This is also useful in other embodiments of the invented air bed on which it is desired to help prevent the user from falling off a side edge of the bed.

Lower head and foot end bolster tubes 39 and 40 are connected to the same output as the side bolster tubes so that the lower end bolster tubes are also maintained at pressure A. This contributes to the stability of the entire bed.

Upper foot end bolster tube 36 is connected by the air hose assembly 77 to output port 75 of the manifold block, which provides pressure C which is lower than pressure A. As a result, the firmness felt by the user at the foot end of the bed is a compromise between pressures A and B. This still provides for reasonable comfort when the user is sitting on the top surface of the bed at the bed's foot end, and it also provides for a soft enough surface for the user's feet to rest upon when the user is reclining on the bed.

The approximately one half of the lower laterally extending cushion tubes 45 closest to the foot end of the bed and the approximately one third of the upper laterally extending cushion tubes 42 closest to the foot end of the bed are all connected by the air hose assembly to manifold block output 75 and maintained at pressure C.

The approximately one half of the lower laterally extending cushion tubes 45 closest to the head end of the bed, and the approximately one half of the upper laterally extending cushion tubes 42 adjacent the upper laterally extending cushion tube maintained at pressure C which is furthest from the foot end of the bed, are all connected to manifold block output 74 and maintained at pressure B, which is less than pressure A and greater than pressure C.

This results in the firmest support from the cushion tubes being applied where the user's chest will be when the user is reclining on the bed (i.e., a combination of pressures B and B from the lower and upper layers of cushion tubes), intermediate support under the users hips (i.e., a combination of pressures B and C from the lower and upper layers of cushion tubes), and the softest support under the user's legs (i.e., a combination of pressures C and C from the lower and upper layers of cushion tubes).

The upper head end bolster tube and the remaining laterally extending cushion tubes in the upper level of tubes are connected to manifold block output 76 and maintained at pressure D. Support for the user's head is determined from the combinations of pressures A and D, and support for the user's shoulders is determined by the combination of pressures B and D.

Thus arrangement comports with the comfort characteristics most people desire. Also, as mentioned above, the output pressures of the manifold block may be individually adjusted to the user's individual comfort.

In another embodiment of the invention, manifold block may be provided with three separately controlled output ports, that is, with output port 76 eliminated, and with the tubes described above as being connected to output port 76 being instead connected to output port 74 and maintained at pressure B.

Figure 8:
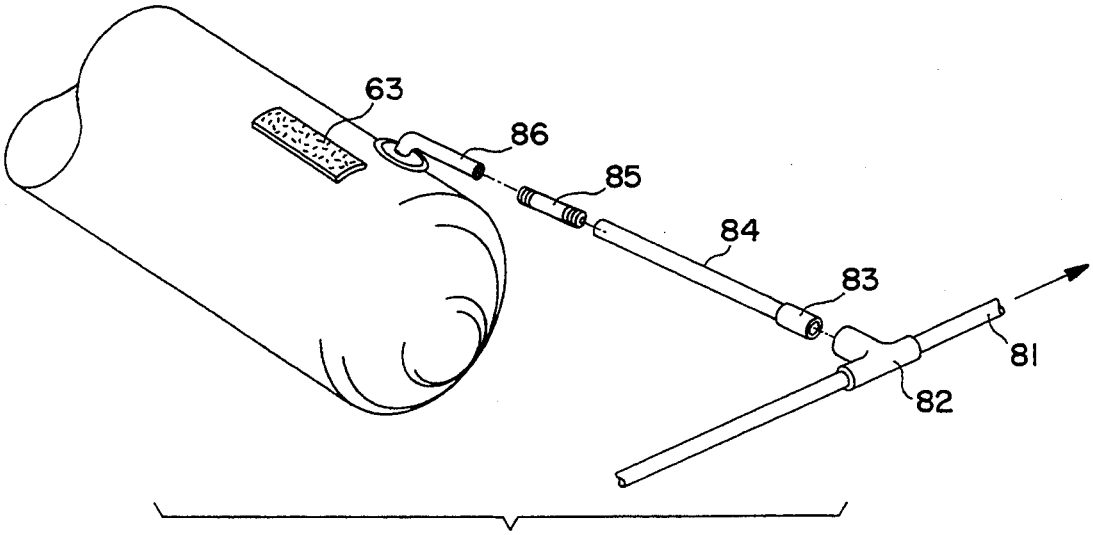
FIG. 8 is an enlarged perspective view of one air tube showing its interconnection to the air delivery system of the present invention.

Referring to FIGS. 7 and 8, detail of a portion of the air hose assembly is shown. The main lines 81, which are connected at one set of ends to an output port of the manifold block, are the biggest in diameter, each having an internal diameter of approximately ½". The air pump and manifold block are, in the preferred embodiment, placed near to and outside of the outer covering 12. The main lines pass through a hole 80 in bottom panel 14, which hole has a reinforced border (see FIG. 3), and are connected at their other ends to T-adapters 82 which are inside the bed's enclosure. The middle leg of the T-adapter is connected to an adapter 83, which is connected to secondary line 84, which has an internal diameter of ⅛". The secondary line 84 is connected to one end of fitting 85, the other end of which is connected to the air tube fill valve stem 86, which has an inner diameter of ⅛".

Air hose 73, valve stem 86, and all the lines, fittings, and adapters of air hose assembly 77 are formed of vinyl. The valve stem should be easily stretchable to accommodate movement of the air hose assembly.

The foregoing describes the transport embodiment of the air bed invention. As indicated above, it can be used in recreational vehicles or truck cabs. The transport embodiment may also be used on boats, in which case the outer cover should be treated with a mildew retarding substance.

A form of fitted bed sheet may be used with the air bed of the present invention. Whereas at least a portion of the border around a conventional fitted sheet's opening is formed of an elastic material, the border around the opening of the fitted sheet used with the present invention would not need to be elastic. That is because it would be fitted over the top half of the bed, with the fitted sheet's border fitting into the fold of the V formed by the gusset, before the air tubes are inflated. When the air tubes are inflated, the fitted bed sheet will be firmly trapped onto the air bed.

The air bed as described above may also be used in the user's home. However, since in the home there is no jarring contact and vibrations passed along to the bed as there is when the bed is used in a moving truck or a recreational vehicle, the "home" embodiment of the bed may be made without the lower level of tubes (i.e., tubes 37, 38, 39, 40 and 45). Gusset 24, retaining straps 52, and lower vertical panel 18 may be omitted, with upper vertical panel 16 sewn directly to bottom panel 14.

Figure 12:
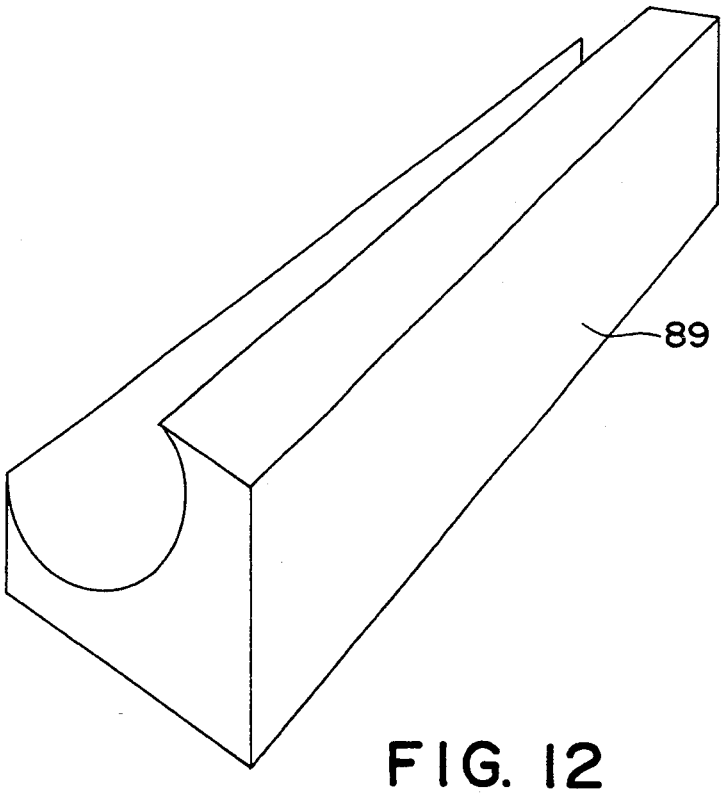
FIG. 12 is a perspective view of a bolster support member used in another embodiment of the present invention.

In the single layer embodiment of the invention, when it is desired to make the air bed of the present invention look like a conventional mattress, each bolster tube is disposed in a bolster support member. The bolster member is formed from a block of polyurethane foam having a rectangular cross section and a length equal to that of the bolster tube to be inserted into it. A C-shaped section is then cut out of a corner of the foam block. A bolster support member 89 so formed is shown in perspective view in FIG. 12.

Figure 13:
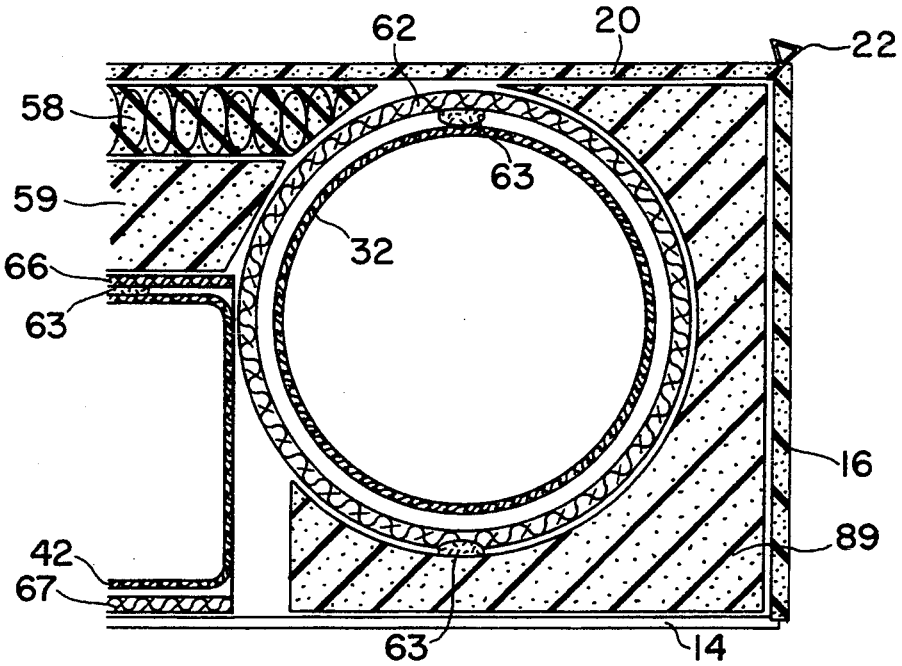
FIG. 13 is a cross sectional view of the right side of the embodiment of the air bed in which the bolster support member illustrated in FIG. 12 is used, shown in exaggerated form to illustrate detail.

Referring to FIG. 13, a cross-sectional view looking along the longitudinal axis of bolster tube 33 is shown to illustrate how the bolster tube sits on the bolster support member. Bolster tube 33 is fitted within sheath 62 and is attached thereto by hook and pile attachment means 63. The sheath and bolster tube are disposed within the C-shaped cut-out of bolster support member 89, and the sheath is attached to the bolster support member with another attachment means 63.

As shown in FIG. 13, in this embodiment of the invention, both the foam pad 58 with the egg crate-shaped cross-section and foam pad 59 with the rectangular cross sections are used. The side edges of the foam pads are beveled to conform somewhat with the surface of the bolster tube.

The transport and home embodiments of the invented air bed may also be used in hospitals or other medical care facilities. In such cases the top panel may be treated to resist the effects of incontinence. If the invented air bed is used for burn victims, the top panel's conventional mattress covering material may be replaced with gauze material adapted for use against burnt tissue.

Figure 10:
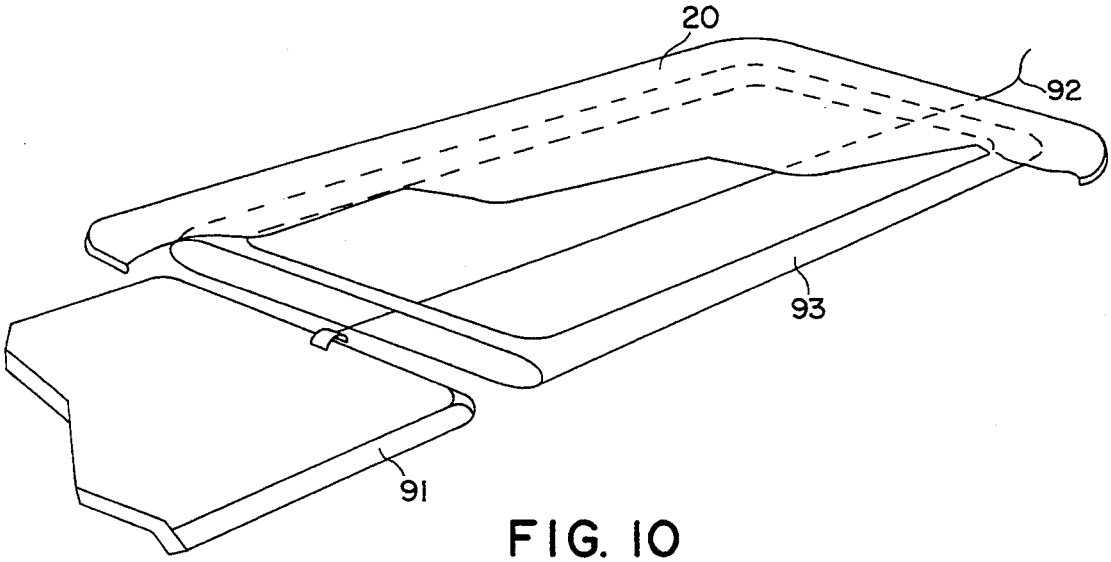
FIG. 10 is a fragmentary perspective view of a pad being assembled for use in another embodiment of the present invention.
Figure 11:
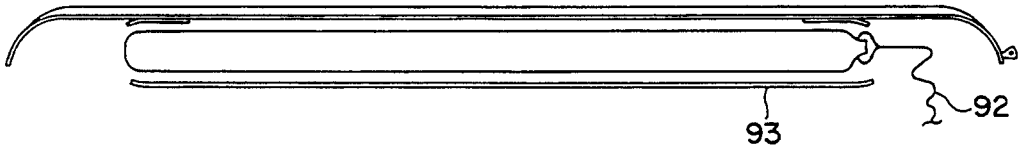
FIG. 11 is a cross sectional view taken from the right side of the pad of FIG. 10.

Also in connection with medical uses, a medicated pad may be disposed on top of or in place of egg crate foam pad 58. Referring to FIGS. 10 and 11, medicated pad has a pull cord 92 attached to it which is used to pull the medicated pad into gas permeable liner 93. In this embodiment, top panel 20 is formed of a gas permeable material. The medicated pad is treated with medication which vaporizes and permeates through the liner and top panel to reach the patient reclining thereon. When the medication is exhausted, the medicated pad is pulled out of the liner and replaced with a new medicated pad.

Figure 14:
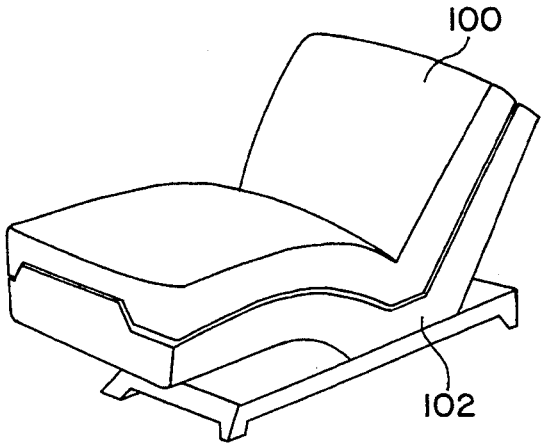
FIG. 14 is a perspective view of another embodiment of the present invention.
Figure 15:
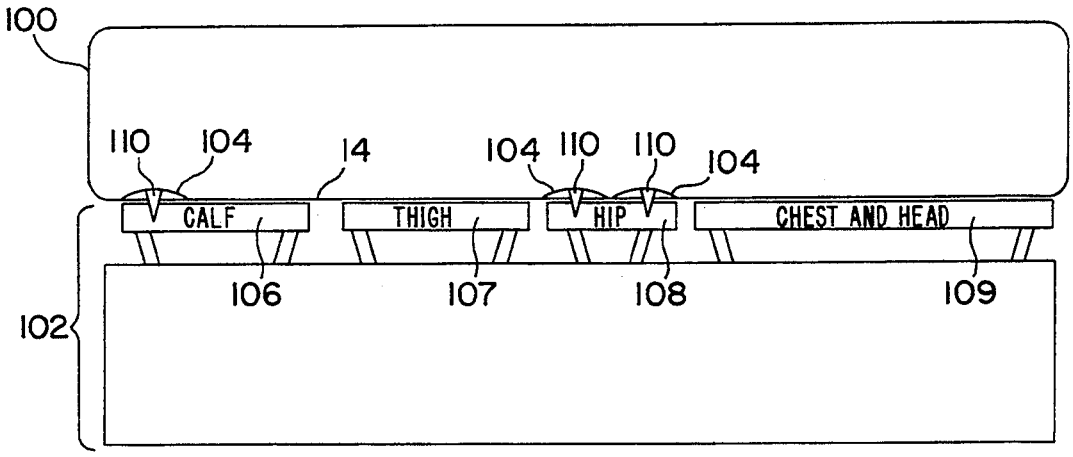
FIG. 15 is a right side elevation cross sectional view of the embodiment of the invention shown in FIG. 14.

The home embodiment of the invented air bed (i.e., the embodiment with only a single layer of tubes) may also be used in combination with an adjustable electric reclining bed pedestal, such as available from Maxwell Products, Inc. FIG. 14 shows the home embodiment of the air bed 100 in the upright position on top of recliner pedestal 102. In FIG. 15 the recliner pedestal 102 is shown in functional representational form, in its fully reclined position. Air bed 100 is shown on top of the pedestal in right side elevational cross section, with only those details illustrated which are necessary to demonstrate how the air bed is connected to the pedestal.

Three wood planks 104, the length of which are almost equal to the width of the bed, are placed laterally across the bed directly on top of bottom panel 14. One plank is positioned above the calf platform 106 of the pedestal (which controls the height and angle of the calf portion of the bed) at the edge of that platform closest to the foot end of the bed. Another plank is positioned above the hip platform 108 of the pedestal at the edge of that platform closest to the foot end of the bed. The third plank is positioned above the hip platform closest to the head end of the bed. No planks need be positioned above the thigh platform 107 or the chest and head platform 109. Each plank is adhesively affixed to the top surface of bottom panel 14, and then screws 110 are driven into each plank, the bottom panel, and the platform above which the plank is positioned. As a result, the air bed is affixed to the pedestal at all the key points, and the position of the air bed will follow the adjustments made by each of the platforms. The screws should be driven sufficiently so that their tops are flush with the upper surface of the planks, and the edges of the planks should be rounded to prevent damage to any of the portions of the air bed which rub against the planks or screws.

A unique improved air bed has been described above. It will be understood that various changes of the details, materials, steps, arrangement of parts and uses which have been herein described and illustrated in order to explain the nature of the invention will occur to and may be made by those skilled in the art, and such changes are intended to be included within the scope of this invention.

I claim:

1. An air bed comprising:

an enclosure formed of flexible material including, a substantially flat rectangular bottom panel having an opening therein, a vertical panel having top and bottom edges, said vertical panel standing perpendicularly up from the periphery of the bottom panel with the bottom edge of the vertical panel connected to said periphery of the bottom panel, and a substantially flat, rectangular top panel having substantially the same length and width as the bottom panel, the periphery of said top panel being removably connected to the top edge of said vertical panel, said enclosure having a longitudinal axis running along its length and a lateral axis running along its width, said enclosure having a foot end at one end of the longitudinal axis of the enclosure, and having a head end at the other end of the longitudinal axis of the enclosure, said enclosure having a right side at one end of the lateral axis of the enclosure when viewed from above, and having a left side at the other end of the lateral axis of the enclosure, an inflatable foot end bolster tube disposed within and laterally across the enclosure at the foot end thereof, an inflatable head end bolster tube disposed within and laterally across the enclosure at the head end thereof, wherein each of said foot and head end bolster tubes has a length substantially equal to the width of the enclosure, an inflatable left side bolster tube disposed longitudinally within said enclosure at the left side thereof, an inflatable right side bolster tube disposed longitudinally within said enclosure at the right side thereof, wherein each of said left and right side bolster tubes has a length substantially equal to the distance between said foot and head end bolster tubes when the foot and head end bolster tubes are disposed in the enclosure and inflated, wherein said left side bolster tube, foot end bolster tube, right side bolster tube, and head end bolster tube when disposed in said enclosure define a rectangular space between them, a plurality of inflatable cushion tubes disposed adjacent to each other and laterally within the rectangular space surrounded by said bolster tubes within said enclosure, wherein each of said cushion tubes has a length substantially equal to the distance between said left and right side bolster tubes when the left and right side bolster tubes are disposed in the enclosure and inflated, wherein the number of said cushion tubes is sufficient to substantially fill said rectangular space, each of said inflatable tubes being enclosed in an open ended sheathing member for reducing the creation of noise when adjacent tubes rub against each other, each of said inflatable tubes having a fill valve, an air pump for providing air pressure to the inflatable tubes, a manifold block connected to said air pump, said manifold block having at least first, second and third output ports, each of which provides a separate, variably controlled output air pressure, and an air hose assembly having two ends, one end of said air hose assembly being connected to the output ports of the manifold block, said air hose assembly passing through the opening in the bottom panel of the enclosure, and the other end of the air hose assembly being connected to the fill valves of the inflatable tubes, whereby air pressure created by the air pump passes through the manifold block and the air hose assembly to the inflatable tubes, said left and right side bolster tubes being connected by said air hose assembly to said first output port of said manifold block, said foot end bolster tube and the cushion tubes closest to the foot end bolster tube being connected through said air hose assembly to said third output port of said manifold block, and said head end bolster tube and the remainder of said cushion tubes being connected through said air hose assembly to said second output port.

2. The air bed of claim 1, wherein the manifold block comprises a fourth output port and wherein said head end bolster tube and the cushion tube adjacent to said head end bolster tube are not connected to said second output port of said manifold block and are instead connected by said air hose assembly to said fourth output port.

3. The air bed of claim 1 wherein attachment means is affixed near the ends of each inflatable tube and near the ends of each adjacent, corresponding sheathing member for detachably attaching said bolster tubes to said sheathing member to prevent rotation of the inflatable tube relative to the sheathing member, and wherein said attachment means is also affixed near the ends of each sheathing member and a portion of the enclosure adjacent thereto for detachably attaching said sheathing member to the enclosure to prevent rotation of the sheathing member relative to said enclosure, whereby entanglement of the air hose assembly is prevented.

4. The air bed of claim 1 wherein each bolster tube and the sheathing member surrounding it are disposed in a foam bolster support member having approximately the same length as the tube which is disposed therein, each bolster support member having a rectangular cross-section with a C-shaped cut out removed from an upper corner, when viewed from its end, into which cut out the bolster tube and its sheathing member fits, each of said bolster support members being disposed within the enclosure adjacent the vertical panel, with the C-shaped cut out facing inwardly and upwardly.

5. The air bed of claim 3 wherein the cross sectional area of each bolster tube, when viewed from an end thereof, is equal to the cross sectional area of each of the other bolster tubes, and wherein the cross sectional area of each cushion tube, when viewed from an end thereof, is equal to the cross sectional area of each of the other cushion tubes.

6. The air bed of claim 5 wherein the cross sectional area of each bolster tube, when viewed from an end thereof, is greater than the cross sectional area of each cushion tube when viewed from an end thereof.

7. The air bed of claim 6 wherein said left side bolster tube is instead a first left side bolster tube and a second left side bolster tube, said first and second left side bolster tubes being disposed end to end, longitudinally within the enclosure at the left side thereof, wherein said right side bolster tube is instead a first right side bolster tube and a second right side bolster tube, said first and second right side bolster tubes being disposed end to end, longitudinally within the enclosure at the right side thereof, each of said first and second left side bolster tubes and said first and second right side bolster tubes having a length substantially equal to one half the distance between said foot and head bolster tubes when the foot and head bolster tubes are disposed in the enclosure and inflated.

8. The air bed of claim 7 further comprising a foam pad having a length and width substantially equal to the length and width of the rectangular space surrounded by the left side bolster tubes, the foot end bolster tube, the right side bolster tubes, and the head end bolster tube, said foam pad being disposed on top of said cushion tubes.

9. The air bed of claim 8 wherein each bolster tube and the sheathing member surrounding it are disposed in a foam bolster support member having approximately the same length as the tube which is disposed therein, each bolster support member having a rectangular cross-section with a C-shaped cut out removed from an upper corner, when viewed from its end, into which cut out the bolster tube and its sheathing member fits, each of said bolster support members being disposed within the enclosure adjacent the vertical panel, with the C-shaped cut out facing inwardly and upwardly.

10. The air bed of claim 8 wherein the sheathing member for said cushion tubes is a magazine having a plurality of open-ended sleeves, equal in number to the number of cushion tubes.

11. The air bed of claim 8 further comprising a plurality of wood planks disposed laterally within said enclosure and connected to the upper surface of said bottom panel, whereby when said air bed is disposed on top of an adjustable reclining bed pedestal, a connecting device may be driven into said planks and portions of said pedestal so that said air bed is fixedly attached to said pedestal.

12. The air bed of claim 7 wherein said top panel is formed of a gas permeable material and a medicated pad is disposed in said enclosure above said cushion tubes.

13. An air bed comprising:

a rectangular enclosure formed of flexible material, said enclosure having a longitudinal axis running along its length and a lateral axis running along its width, said enclosure having a foot end at one end of the longitudinal axis of the enclosure, and having a head end at the other end of the longitudinal axis of the enclosure, said enclosure having a right side at one end of the lateral axis of the enclosure when viewed from above, and having a left side at the other end of the lateral axis of the enclosure, said enclosure including, a substantially flat rectangular bottom panel having an opening therein, a lower vertical panel having top and bottom edges, said lower vertical panel standing perpendicularly up from and surrounding the periphery of the bottom panel with the bottom edge of the lower vertical panel connected to said periphery of the bottom panel, an upper vertical panel having top and bottom edges, said upper vertical panel disposed vertically above said lower vertical panel, a gusset member having top and bottom edges, said gusset member being disposed between said lower and upper vertical panels, the bottom edge of said gusset member being connected to the top edge of said lower vertical member and the top edge of said gusset member being connected to the bottom edge of said upper vertical member, a substantially flat, rectangular top panel having substantially the same length and width as the bottom panel, the periphery of said top panel being removably connected to the top edge of said upper vertical panel, and a plurality of restraining straps disposed across the width of the enclosure, with one end of each restraining strap connected to the gusset member along the left side of the enclosure and the other end of each restraining strap attached to the gusset member along the right side of the enclosure;

an inflatable lower foot end bolster tube disposed within and laterally across the enclosure, below said restraining straps, at the foot end of said enclosure, adjacent said lower vertical panel, said inflatable lower foot end bolster tube having a length substantially equal to the width of the enclosure;

an inflatable lower head end bolster tube disposed within and laterally across the enclosure, below said restraining straps, at the head end of said enclosure, adjacent said lower vertical panel, said inflatable lower head end bolster tube having a length substantially equal to the width of the enclosure;

an inflatable lower left side bolster tube disposed longitudinally within said enclosure at the left side thereof, below said restraining straps, adjacent said lower vertical panel, said inflatable lower left side bolster tube having a length substantially equal to the distance between said lower foot and lower head end bolster tubes when the lower foot and lower head end bolster tubes are disposed in the enclosure and inflated;

an inflatable lower right side bolster tube disposed longitudinally within said enclosure at the right side thereof, below said restraining straps, adjacent said lower vertical panel, said inflatable lower right side bolster tube having a length substantially equal to the distance between said lower foot and lower head end bolster tubes when the lower foot and lower head end bolster tubes are disposed in the enclosure and inflated;

said lower left side bolster tube, lower foot end bolster tube, lower right side bolster tube, and lower head end bolster tube, when disposed in said enclosure, defining a lower rectangular space between them;

a plurality of inflatable lower cushion tubes disposed adjacent to each other and laterally within the lower rectangular space surrounded by said lower left side bolster tube, lower foot end bolster tube, lower right side bolster tube, and lower head end bolster tube, each of said lower cushion tubes having a length substantially equal to the distance between said lower left and lower right side bolster tubes when the lower left and lower right side bolster tubes are disposed in the enclosure and inflated, the number of said lower cushion tubes being sufficient to substantially fill said lower rectangular space;

an inflatable upper foot end bolster tube disposed within and laterally across the enclosure, above said restraining straps, at the foot end of said enclosure, adjacent said upper vertical panel, said inflatable upper foot end bolster tube having a length substantially equal to the width of the enclosure;

an inflatable upper head end bolster tube disposed within and laterally across the enclosure, above said restraining straps, at the head end of said enclosure, adjacent said upper vertical panel, said inflatable upper head end bolster tube having a length substantially equal to the width of the enclosure;

an inflatable upper left side bolster tube disposed longitudinally within said enclosure at the left side thereof, above said restraining straps, adjacent said upper vertical panel, said inflatable upper left side bolster tube having a length substantially equal to the distance between said upper foot and upper head end bolster tubes when the upper foot and upper head end bolster tubes are disposed in the enclosure and inflated;

an inflatable upper right side bolster tube disposed longitudinally within said enclosure at the right side thereof, above said restraining straps, adjacent said upper vertical panel, said inflatable upper right side bolster tube having a length substantially equal to the distance between said upper foot and upper head end bolster tubes when the upper foot and upper head end bolster tubes are disposed in the enclosure and inflated;

said upper left side bolster tube, upper foot end bolster tube, upper right side bolster tube, and upper head end bolster tube, when disposed in said enclosure, defining a upper rectangular space between them;

a plurality of inflatable upper cushion tubes disposed adjacent to each other and laterally within the upper rectangular space surrounded by said upper left side bolster tube, upper foot end bolster tube, upper right side bolster tube, and upper head end bolster tube, each of said upper cushion tubes having a length substantially equal to the distance between said upper left and upper right side bolster tubes when the upper left and upper right side bolster tubes are disposed in the enclosure and inflated, the number of said upper cushion tubes being sufficient to substantially fill said upper rectangular space;

sheathing means surrounding each inflatable tube for reducing the creation of noise when adjacent tubes rub against each other;

fill valve means attached to each inflatable tube for filling said tubes with air;

an air pump for providing air pressure to the inflatable tubes;

a manifold block connected to said air pump, said manifold block having at least first, second and third output ports, each of which provides a separate, variably controlled output air pressure; and an air hose assembly having two ends, one end of said air hose assembly being connected to the output ports of the manifold block, said air hose assembly passing through the opening in the bottom panel of the enclosure, and the other end of the air hose assembly being connected to the fill valves means of the inflatable tubes, said lower foot end, lower left side, upper left side, lower right side, upper right side and lower head end bolster tubes being connected by said air hose assembly to said first output port of said manifold block, said upper foot end bolster tube and the approximately one half of the lower cushion tubes closest to the lower foot end bolster tube and the approximately one third of the upper cushion tubes closest to the upper foot end bolster tube being connected by said air hose assembly to said third output port of said manifold block, and said head end bolster tube and the remainder of said lower and upper cushion tubes being connected by said air hose assembly to said second output port.

14. The air bed of claim 13, wherein the manifold block comprises a fourth output port and wherein said upper head end bolster tube and the upper cushion tube adjacent to said upper head end bolster tube are not connected to said second output port of said manifold block and are instead connected by said air hose assembly to said fourth output port.

15. The air bed of claim 13 wherein attachment means is affixed near the ends of each inflatable tube and near the ends of each adjacent, corresponding sheathing means for detachably attaching each of said inflatable tubes to said sheathing means to prevent rotation of the inflatable tube relative to the sheathing means, and wherein said attachment means is also affixed near the ends of each sheathing means and a portion of the enclosure adjacent thereto for detachably attaching said sheathing means to the enclosure to prevent rotation of the sheathing means relative to said enclosure, whereby entanglement of the air hose assembly is prevented.

16. The air bed of claim 15 wherein the cross sectional area of each bolster tube, when viewed from an end thereof, is equal to the cross sectional area of each of the other bolster tubes, and wherein the cross sectional area of each cushion tube, when viewed from an end thereof, is equal to the cross sectional area of each of the other cushion tubes.

17. The air bed of claim 16 wherein the cross sectional area of each bolster tube, when viewed from an end thereof, is greater than the cross sectional area of each cushion tube when viewed from an end thereof.

18. The air bed of claim 16 wherein said upper left side bolster tube is instead a first upper left side bolster tube and a second upper left side bolster tube, said first and second upper left side bolster tubes being disposed end to end, longitudinally within the enclosure at the left side thereof, wherein said upper right side bolster tube is instead a first upper right side bolster tube and a second upper right side bolster tube, said first and second right side bolster tubes being disposed end to end, longitudinally within the enclosure at the right side thereof, each of said first and second upper left side bolster tubes and said first and second upper right side bolster tubes having a length substantially equal to one half the distance between said foot and head bolster tubes when the foot and head bolster tubes are disposed in the enclosure and inflated.

19. The air bed of claim 18 further comprising a foam pad having a length and width substantially equal to the length and width of the rectangular space surrounded by the upper left side bolster tubes, the upper foot end bolster tube, the upper right side bolster tubes, and the upper head end bolster tube, said foam pad being disposed on top of said upper cushion tubes.

20. The air bed of claim 19 further comprising a left cinch belt member formed of elastic material attached to the bottom panel adjacent the left side of said enclosure and wrapped around the inwardly disposed ends of said first and second upper left side bolster tubes, and a right cinch belt member formed of elastic material attached to the bottom panel adjacent the right side of said enclosure and wrapped around the inwardly disposed ends of said first and second upper right side bolster tubes.

21. The air bed of claim 20 wherein the sheathing means for said upper cushion tubes is an upper magazine having a plurality of open-ended sleeves, equal in number to the number of upper cushion tubes and the sheathing means for said lower cushion tubes is an lower magazine having a plurality of open-ended sleeves, equal in number to the number of lower cushion tubes.

22. The air bed of claim 21 wherein said restraining belts are made from rip stop nylon.

23. The air bed of claim 21 wherein said bottom panel is made from rip stop nylon.

24. The air bed of claim 21 wherein said gusset member is made from rip stop nylon.

* * * * *